US006115904A

United States Patent [19]

Merrill et al.

[11] Patent Number: 6,115,904

[45] Date of Patent: Sep. 12, 2000

[54] ROTATABLE DEWIRING APPARATUS AND METHOD

[75] Inventors: Stanley R. Merrill, Hoquiam, Wash.; Michael E. Hawley, Beaconsfield, Canada; Paul Dalietos, Tumwater, Wash.

[73] Assignee: Lamb-Grays Harbor Co., Hoquiam, Wash.

[21] Appl. No.: 08/962,226

[22] Filed: Oct. 31, 1997

(Under 37 CFR 1.47)

[51] Int. Cl.[7] ..... B23P 19/00; B65B 69/00

[52] U.S. Cl. ..... 29/426.4; 29/564.3; 83/909

[58] Field of Search ..... 29/564.3, 426.4, 29/426.3, 56.5, 564.7; 83/909; 140/92.2, 102; 242/470; 414/412

[56] References Cited

U.S. PATENT DOCUMENTS

| | | | |
|---|---|---|---|
| 3,521,347 | 7/1970 | Bentley | 29/564.3 X |
| 3,557,591 | 1/1971 | Lind | 29/564.3 |
| 4,205,419 | 6/1980 | Aoshima | 29/56.5 |
| 4,437,223 | 3/1984 | Petros | 29/564.3 |
| 4,783,892 | 11/1988 | Hergeth | 29/426.4 |
| 4,831,713 | 5/1989 | Hoden et al. | 29/564.3 |
| 4,835,836 | 6/1989 | van Uitert | 29/564.3 |
| 4,838,751 | 6/1989 | Hanaya et al. | 83/909 X |
| 4,841,619 | 6/1989 | Teériault | 29/426.3 |
| 4,850,087 | 7/1989 | Gronan | 29/33 R |
| 5,079,826 | 1/1992 | Ecrums et al. | 29/564.3 |
| 5,105,527 | 4/1992 | Miyata | 29/564.3 |
| 5,163,216 | 11/1992 | Ercums et al. | 29/564.3 |
| 5,174,010 | 12/1992 | Asselin | 29/564.3 |
| 5,199,841 | 4/1993 | Von Gehlen | 414/412 |
| 5,375,316 | 12/1994 | Carlston et al. | 29/564.3 |
| 5,400,493 | 3/1995 | Hall | 29/426.4 |

FOREIGN PATENT DOCUMENTS

| | | |
|---|---|---|
| 0251414 | 1/1988 | European Pat. Off. . |
| 0281942 | 9/1988 | European Pat. Off. . |
| WO 9213768 | 8/1992 | WIPO . |
| Wo 9317916 | 9/1993 | WIPO . |

*Primary Examiner*—William Briggs
*Attorney, Agent, or Firm*—Seed Intellectual Property Law Group PLLC

[57] ABSTRACT

An apparatus and method for severing and removing wires surrounding a bale of pulp are disclosed, as well as a unique severing and coiling head. A bale of pulp is loaded onto a turn conveyor and the turn conveyor transports the bale from where it was loaded to the operating position, where a containment disk is lowered onto the top of the bale to restrain the wires wrapped around the bale during severing. A control arm moves a severing head until the head is in contact with the lateral surface of the bale, and keeps it there during the severing and removal process. The turn conveyor rotates the bale through 360 degrees about its vertical axis, thus drawing the severing head across each of the four lateral faces of the bale. The severing blade's teeth engage the wires, pull them free from the bale, and coil them around a spool that is coaxial with the severing blade and attached thereto. The last 90 degree increment of the bale's rotation draws the severing blade across the fourth lateral face of the bale, where the wires are removed in the same way as along the third lateral face. When all the wires are removed, the severing head moves away from the bale to discharge position, the angular velocity of the blade is reversed and increased, and the coiled wire is discharged into a receptacle. The containment disc is raised and the conveyor chain transports the bale away.

21 Claims, 5 Drawing Sheets

ROTATABLE DEWIRING APPARATUS AND METHOD

TECHNICAL FIELD

This invention pertains to an apparatus and a method for cutting or breaking through wires tightly wrapped around a bale of market pulp and removing the wires.

BACKGROUND OF THE INVENTION

In general, wires are removed from bales of pulp by holding the bale in a fixed position and rotating it about an axis while a severing and removing device is held against, and thus drawn across, the bale's surface. As it traverses the surface of the bale, the severing and removing device engages the wires, severs them, and removes them.

SUMMARY OF THE INVENTION

The invention basically pertains to an apparatus and method for removing wire wrapped around a bale of market pulp. The severing and coiling head used by the apparatus to remove wires is also a unique invention. Basically, the invention includes a means for supporting and rotating the bale about an axis through its center, a means for severing the wire at one rotational position of the bale, and a means for pulling the severed wire off the bale at a second rotational position of the bale.

In the preferred embodiment, the apparatus has a turn conveyor which transports the bale to its operating position, rotates the bale through 360 degrees, and then transports the bale away from its operating position. Adjacent to the turn conveyor is a frame which supports a first arm having on its end a containment disc which is lowered onto the top of the bale. The downward force applied by the containment disc is great enough to hold the wires on the bale as they are being severed but small enough to allow the wires to be pulled off the bale after severing. The frame also supports a second arm having a severing head on its end. The second arm is rotated so as to bring the severing head into contact with the surface of the bale as the bale rotates. During rotation of the bale, the severing head comes into contact with wires at a first rotational location and severs them. At a second rotational location, the severing head and a coiling head come into contact with the back side of the wires that had been previously severed, pulling them away from the bale and coiling them around a spool. When the bale has gone through a complete rotation and all the wires have been removed, the first arm lifts the containment disk off the bale, the second arm draws the severing head away from the bale, the severing head deposits the coil of wire in a wire collecting receptacle, and the bale is transported away.

The method invention is basically rotating a bale 360° at a single position to expose the wires or straps to a severing device at a severing and removing location. The bale is moved through one increment of rotation to expose wire or wires around first opposite sides of the bale where the wires are severed, next the bale is rotated through a second increment of rotation to expose the next wire or wires on the removing opposite sides of the bale, where these wires are severed, then the bale is rotated through a third increment of rotation to expose the previously cut wires to the severing and removing location where the severed wires are removed, and finally rotating the bale through a fourth increment of rotation to expose the second set of severed wires to the severing and removing location where the remaining wires are removed.

As is readily apparent, the apparatus and method have several advantages. Among these are that the apparatus is capable of dewiring all types of market pulp bales, including wrapped or unwrapped bales, dry sheet bales, flash dried bales, and wet lap bales. The apparatus also has the advantage of reducing the cycle time for processing of a bale, and it is also easier to build and maintain than previously available machines.

DETAILED DESCRIPTION OF THE INVENTION

Figure 5:
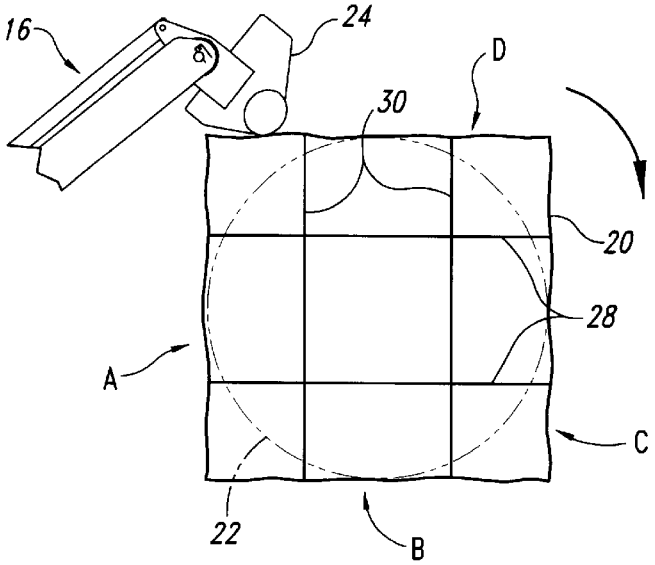
FIGS. 5–9 are schematics showing the typical arrangement of wires on the bale and illustrating the steps in the method by which the wires are severed and removed from the bale by the severing head.

A typical tying arrangement for a bale of pulp is shown in FIG. 5. As is well known, the bale 20 is generally tied with four wires: two wires 28 wrapped vertically around the bale in one direction, and two other wires 30 wrapped vertically around the bale in another direction. With this arrangement, the bale has two wires running vertically along each lateral face of the bale and four wires intersecting each other along the top and bottom faces of the bale. Note that, although the preceding arrangement of wires on the bale is typical, the apparatus is capable of processing a bale with one wire or several wires wrapped around it.

Figure 1:
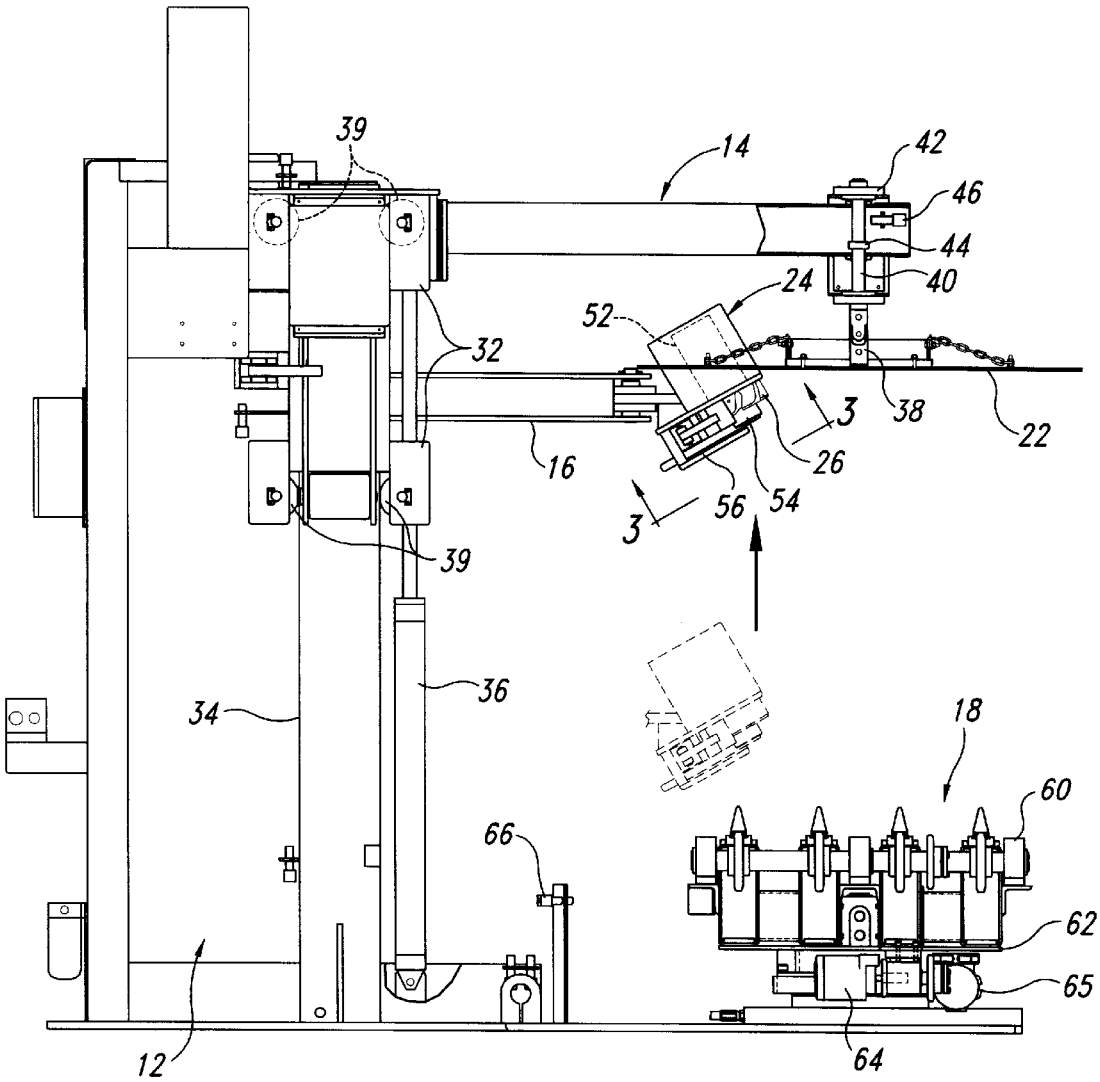
FIG. 1 is a side elevation of the apparatus.

The overall structure and operation of the apparatus is best shown in FIG. 1. The dewiring apparatus consists of a frame 12, support arm 14, and a control arm 16. The support arm 14 is connected at one end to a carriage 32 and at its opposite end to a containment disc 22. The control arm 16 is connected to the carriage 32 at one end and to a severing head 24 at the other end. The carriage 32 is slidably connected to vertical member 34 by guide rollers 39, and the vertical member is firmly attached to frame 12. Located adjacent to the frame is a turn conveyor 18 which rotates about a vertical axis and supports the bale 20.

When the machine is in operation, the bale 20 is placed upon the turn conveyor 18, which transports the bale to a location directly below the containment disc 22. The support arm 14 lowers the containment disc onto the top of the bale 20 in order to hold the wires on the bale during the severing process. After the containment disc 22 is lowered onto of the bale 20, the control arm 16 swings away from the frame 12, bringing the coiling head 24 into engagement with the lateral surface of bale 20. The turn conveyor 18 begins to rotate the bale 20 and the teeth of severing blade 26 (FIG. 3), which turns at a higher angular velocity than the conveyor, come into contact with wires wrapped around the bale, engage them, and sever them. The term "sever" is here used to mean either "breaking" the wire or "cutting." As the bale continues to rotate, wires that had been previously severed by the severing blade again come into contact with the severing blade; the severing blade engages these previously cut wires, pulls them free from the bale, and coils the wires around a spool 54. With continuing rotation of the bale, the remaining severed wires on the bale come into contact with the severing blade and also are removed from the bale and coiled. When all the wires have been removed from the bale, control arm 16 swings away from the bale to a discharge position where the coils of wire are ejected from the spool into a receptacle, and then returns to a home position where the control arm sits until the next bale is loaded into the apparatus and is ready to be processed.

Figure 2:
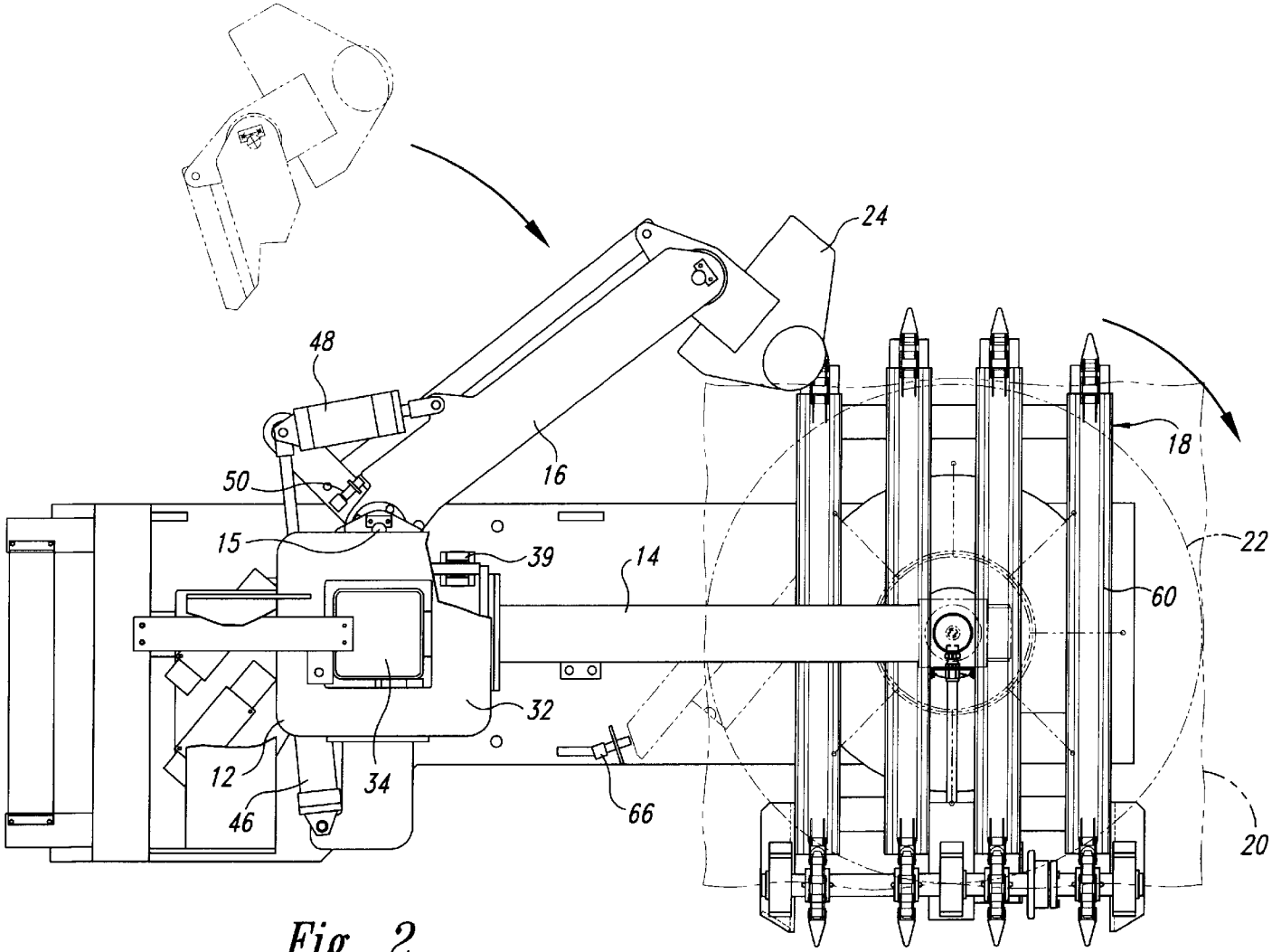
FIG. 2 is a top view of the apparatus.

As best shown in FIGS. 1 and 2, the support arm 14 is mounted to a carriage 32 slidably attached to a vertical member 34 by guide rollers 39. The vertical member 34 is a hollow tube with square cross section attached to the frame 12. The carriage is a single unit into which the vertical member is inserted. A series of flanges on the carriage support eight guide rollers 39 that guide the carriage along the vertical member, with two rollers traveling along each side of the vertical member 34. A hydraulic cylinder 36 connects the carriage to the frame and drives the vertical motion of the carriage. At the opposite end of the support arm from the carriage is mounted the containment disc 22.

FIG. 1 shows the details of the connection of the containment disc 22 to the support arm 14. The containment disc is attached via a universal joint 38 to a vertical shaft 40 which is slidably attached to the support arm. The vertical shaft is held in place by a retaining ring 42 and is capable of a limited amount of vertical motion, its downward motion being limited by the retaining ring and its upward motion being limited by set collar 44.

When the apparatus is in operation, hydraulic cylinder 36 lowers the carriage, thus lowering the containment disc 22 onto the bale 20. When the containment disc comes in contact with the top of the bale, the vertical shaft 40 is pushed upward relative to the support arm until the set collar 44 trips a bale position switch 46, signaling to the machine that the containment disc is in contact with the top of the bale and that the downward motion of the support arm should cease. The universal joint 38 allows the containment disc to adjust to any irregularities in the top of the bale; for example, if the bale is not perfectly square so that the top of the bale is not perfectly horizontal, then the universal joint 38 allows the containment disc to be positioned such that it is still flush with the top of the bale. The downward force applied to the top of the bale by the containment disc is great enough to hold the wires on the bale as they are severed and the tension therein is released, but small enough to allow the wires to slide between the bale and the containment disc so that they may be pulled off the bale after severing.

The structure and operation of the control arm 16 are best illustrated in FIGS. 1 and 2. The control arm is a four bar parallelogram linkage that is pinned to the carriage 32 in such a manner that the control arm moves vertically with the carriage and rotates around the pin 15. Because the support arm 14 is also attached to the carriage, a constant separation is maintained between the support and control arms. The rotation of the control arm 16 about the pin 15 is driven by pneumatic cylinder 46, which is attached to the carriage at one end and to the control arm at its opposite end. The articulation of the four bar linkage to articulate the severing head 24 relative to the control arm is by pneumatic cylinder 48 attached to two links of the four bar linkage. Severing head 24 is attached to the control arm on the opposite end from where the arm is attached to the carriage.

During operation of the apparatus, the pneumatic cylinder 48 rotates the control arm until the severing head 24 is in contact with the surface of the bale and keeps the severing head tracking around the bale in contact with the surface of the bale as the bale rotates. As the control arm rotates about the pin, the pneumatic cylinder 48 articulates the four bar mechanism so as to keep the severing head squarely against the surface of the bale, thus optimizing the operation of the severing head. When the bale has rotated through 360 degrees and all the wires have been removed therefrom, the pneumatic cylinders 46 and 48 rotate the control arm away from the bale to a fully retracted position where the coiled wire is ejected from the coiling head. The pneumatic cylinder 46 then rotates the control arm back towards the bale until the control arm trips an arm home switch 50, indicating to the machine that the arm is in its home position and ready to process a new bale.

Figure 3:
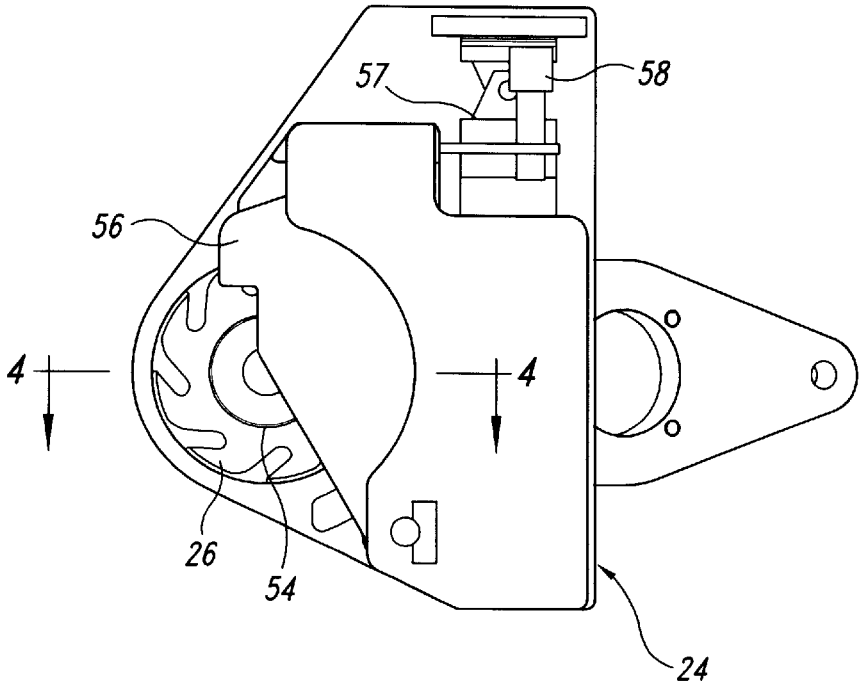
FIG. 3 is a bottom view of the severing head.
Figure 4:
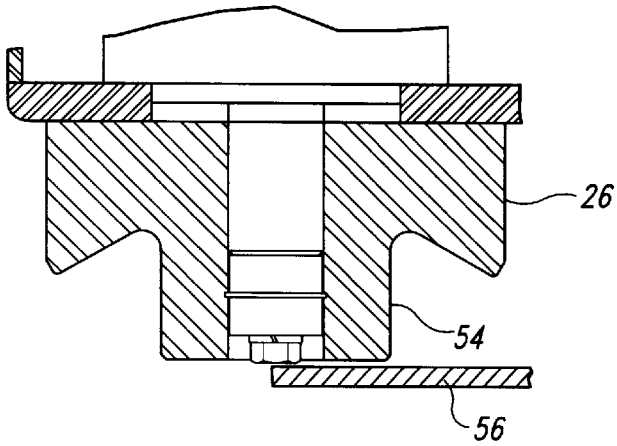
FIG. 4 is a section taken along the lines 4—4 of FIG. 3 but shown inverted to better show its position during operation of the apparatus.

FIGS. 3 and 4 illustrate the severing head 24. The severing head has a hydraulic motor 52 (FIG. 1) which connects to, and rotates, a circular severing blade 26. A cylindrical spool 54 having a smaller diameter than the severing blade is mounted concentrically with the severing blade, and a retention plate 56 extends across the bottom of the spool to keep the coil of wire wrapped around the spool from sliding off. A particular embodiment where the coiling blade 26 and the spool 54 are integrally formed into one piece is shown in FIG. 4. Furthermore, the severing blade preferably has blunt teeth to break rather than cut the wires; however, the invention also contemplates cutting the wires and using an independent separate wire removing apparatus not integral with the severing head.

During operation of the severing head, hydraulic motor 52 turns the severing blade 26 at an angular velocity that is greater than the angular velocity of the turn conveyor; typically, the angular velocity of the blade is about 80 rpm. When the blade comes in contact with a wire that has not yet been severed, the teeth on the blade engage the wire and sever it. The wire remains on the bale after severing due to the containment disk, and as the bale continues to rotate and the head encounters a wire that has already been severed, the teeth on the blade once again engage the wire, but this time the blade pulls the wire off the bale and coils it around the spool 54. The wires are kept on the spool by retention plate 56.

Figure 6:
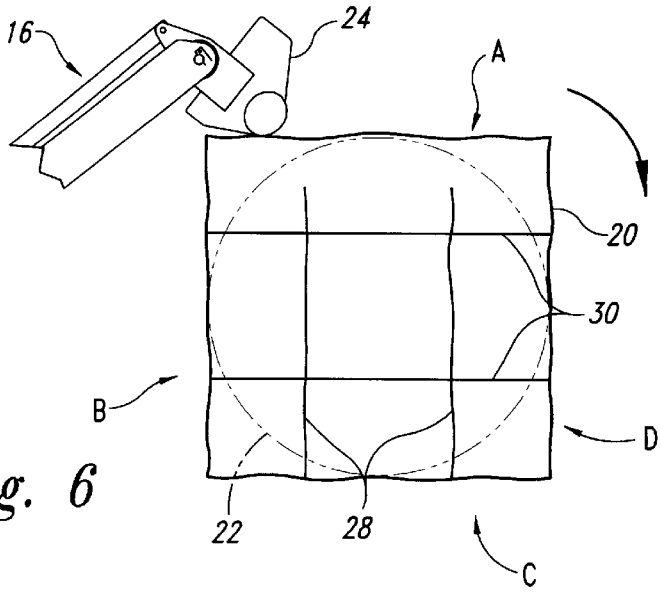
Figure 7:
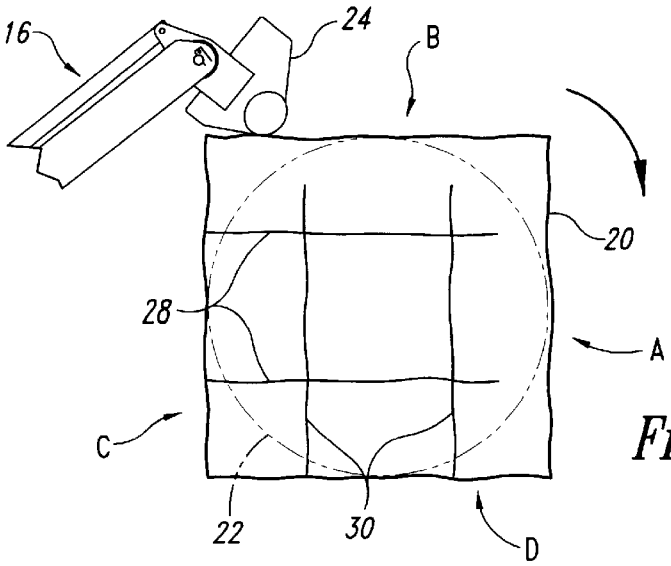
Figure 8:
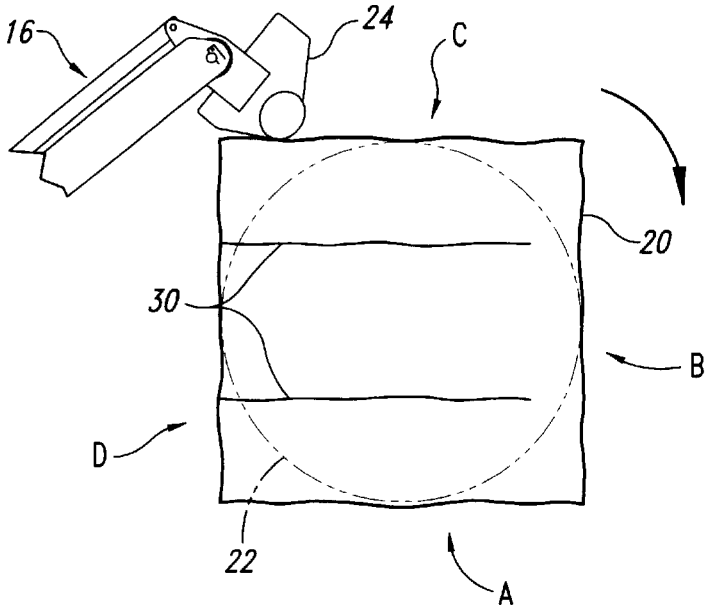
Figure 9:
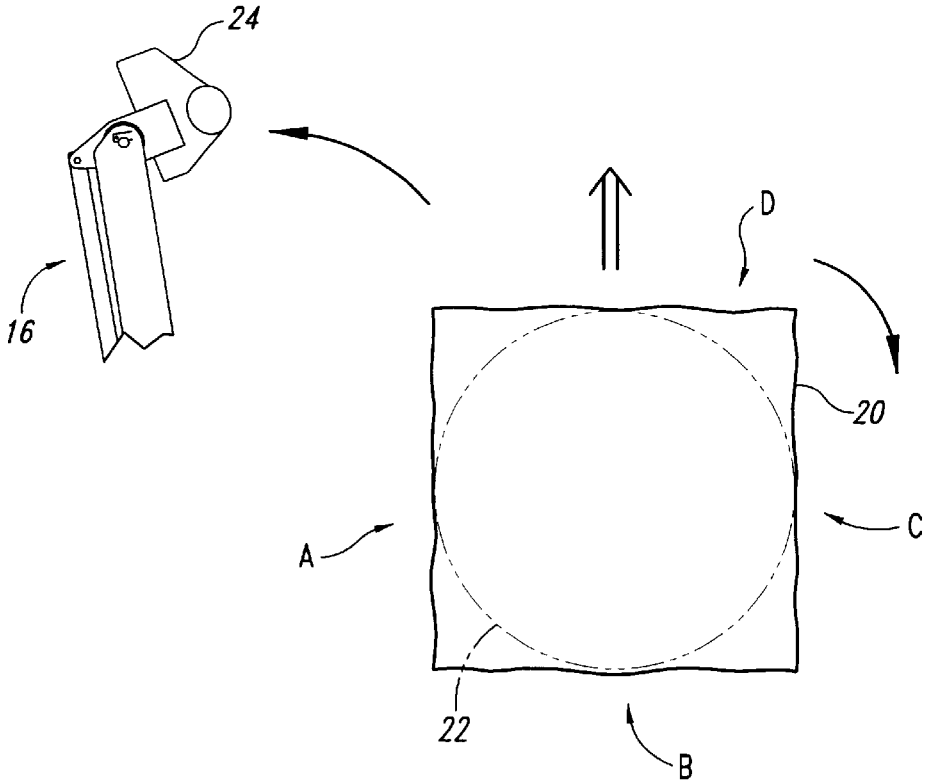

FIGS. 5–9 best illustrate the sequence of events involved in removing the wires from the bale and best show the method of the invention. The figures show the severing head 24 being held in its operational position against the surface of the bale by the control arm 16, and also show the containment disc 22 in its lowered position on the top of the bale. The cycle starts with FIG. 5, where the severing head has just been brought into contact with the surface of the bale. As the bale turns through the first 90 degrees of rotation, as shown in FIG. 6, the head follows the bale's surface along face A, encounters the first set of wires 28, and severs them as described above. As the bale continues to rotate through its second 90 degree turn, the coiling head moves along face B of the bale, as shown in FIG. 7, where it encounters the second set of wires 30 and also severs them. A third 90 degree rotation of the bale, shown in FIG. 8, moves the head along face C of the bale, where it again encounters the first set of wires 28 which were severed along face A during the first 90 degree rotation. Because the wires are already severed, the blade engages the wires 28, pulls them off the bale, and coils them around the spool 54 as described above. After the wires 28 have been pulled away from the bale at face C, the bale makes its last 90 degree rotation as shown in FIG. 9, and the coiling head moves along face D where it encounters the remaining set of severed wires 30 and pulls them away from the bale in the same manner as it did with wires 28 along face C. FIG. 9 shows the bale at the end of its cycle where all wires have been removed and is being transported away on the turn conveyor.

When the cycle is completed as described above, the control arm moves the severing head from its operating position against the surface of the bale to a discharge position. Upon reaching the discharge position, the retention plate 56 is rotated away from its position at the end of the spool by hydraulic cylinder 57, until it trips the table open switch 58, indicating its fully retracted position. The severing blade and spool are rotated in reverse at an angular velocity of 120 rpm. The retraction of the retention plate leaves the end of the spool clear so that the wires, which were removed from the bale and are now coiled around the spool, can slide off the spool and into a receptacle. Once the coils of wire are discharged, the retention plate returns to its closed position over the end of the spool and the control arm is moved back towards the bale until it trips the arm home switch 50, thus indicating to the machine that it is ready to receive and process a new bale.

FIGS. 1 and 2 best illustrate the operation of turn conveyor 18. The turn conveyor has a 4-strand conveyor chain assembly 60 mounted atop a turntable 62, the turn conveyor being driven by hydraulic motor 64. When in operation, the turn conveyor starts out in a home position where it is in contact with the turn conveyor home position switch 66. When a bale is loaded on the turn conveyor, the conveyor chain assembly transports the bale to a position directly beneath the containment disc. The containment disc is lowered upon the top of the bale and the turn conveyor proceeds to turn the bale through 360 degrees about its vertical axis while the severing head removes the wires from the bale as described above. When the turn conveyor has gone through a full rotation, it again comes in contact with the turn conveyor home position switch 66, signaling to the machine that the cycle is finished, so that the control arm 16 should be retracted, the containment disk 22 should be lifted, and the bale should be transported off the turn conveyor. After the retraction of the control arm and the lifting of the containment disk, the hydraulic motor 65 begins to drive the conveyor chain again and the bale is transported off the conveyor chain at the opposite end from where it was loaded onto the conveyor chain.

While the preferred embodiments of the invention have been illustrated and described, it should be understood that variations will be apparent to one of ordinary skill in the art. Accordingly, the invention is not to be limited to the specific embodiments or method steps illustrated in the drawings or described in the specification.

We claim:

1. An apparatus suitable for removing wire wrapped around a bale comprising:

a frame having a first and second vertical axes;

a turntable mounted adjacent to the frame for rotation about a vertical axis through the center of the turntable;

a support arm having proximal and distal ends whose proximal end is connected to the frame for vertical movement along the first vertical axis of the frame;

a containment disk rotatable about a vertical axis through the center of the disk and connected to the distal end of the support arm overlying the turntable;

a control arm having proximal and distal ends whose proximal end is rotatable about the second vertical axis of the frame and vertically moveable relative to the frame, such that the control arm translates vertically and rotates between a fully retracted position and a fully deployed position;

a wire removing mechanism connected to the distal end of the control arm;

a conveyor for positioning the bale; and a control mechanism for moving the containment disk down against the bale centered over the turntable vertical axis, and holding the wire removing mechanism against the bale as the bale is rotated by the turntable to first sever the wires on one side of the bale at a first rotational position of the bale, and then pulling the severed wires off the bale at a second rotational position of the bale.

2. The apparatus of claim 1 wherein the conveyor is positioned on the turntable.

3. The apparatus of claim 2, further comprising a carriage slidably attached to the frame for movement along said first vertical axis of said frame, and wherein the support and control arms are both mounted to the carriage.

4. The apparatus of claim 3 wherein the control arm comprises a four-bar parallelogram linkage to articulate the wire removing mechanism relative to the control arm.

5. The apparatus of claim 1 wherein the wire removing mechanism comprises a shaft having an axis of rotation, a toothed blade connected to the shaft, a spool connected to the shaft and disposed coaxially with the toothed blade, and a motor connected to the shaft, wherein the blade first breaks the wire and later the blade pulls the cut wire off the bale and onto the spool, and a retention plate for holding the wire on the spool.

6. An apparatus suitable for removing wire wrapped around a bale of pulp comprising:

a frame comprising a vertical member, wherein the vertical member forms a vertical axis of translation;

a turntable adjacent to the frame, wherein the turntable is horizontally disposed and rotates about a vertical axis through its center;

a support arm having proximal and distal ends whose proximal end is vertically slidably connected to the vertical member and translates along the vertical member;

a containment disk connected to the distal end of the support arm, wherein the containment disk overlies the turntable and rotates about a vertical axis through the center of the disk;

a control arm having proximal and distal ends whose proximal end is rotatably and vertically slidably connected to the frame;

a severing head attached to the distal end of the control arm;

a wire pulling device for pulling severed wires off the bale; and a turn conveyor wherein the turn conveyor carries the bale from a first location to an operating location between the turntable and the containment disk, rotates the bale, and carries the bale from the operating position where the severing head severs the wires to a discharge location.

7. The apparatus of claim 6 wherein the control and support arms maintain a constant vertical distance between them.

8. The apparatus of claim 6 wherein the severing head is connected to the control arm by a four-bar linkage, so that the severing head can be articulated relative to the control arm.

9. The apparatus of claim 6, further comprising a carriage that is slidably connected to the vertical member, the control arm and the support arm being carried on the frame by the carriage.

10. The apparatus of claim 6 wherein the severing head comprises a shaft along an axis of rotation, a spool connected to the shaft and disposed coaxially with the severing blade, a motor connected to the shaft, and a retention plate on the shaft for holding the coiled wire on the spool.

11. An apparatus suitable for removing wire wrapped in vertical planes around a bale comprising:

support means for supporting and rotating the bale about a vertical axis through its center;

means for engaging the wire on the bale with a wire severing mechanism at one rotational position of the bale about said vertical axis as the bale is rotated and severing the wire, the engaging means engaging the wire at a first location relative to the support means;

means for pulling the severed wire off the bale at a second rotational position of the bale about said vertical axis as the bale is rotated at said first location related to the support means.

12. The apparatus of claim 11 wherein the means for engaging the wire is included in the means for pulling the severed wire.

13. The apparatus of claim 11, further including means independent of the support means for releasably holding severed wires against the bale as the bale is rotated about the vertical axis.

14. A method for removing generally vertical wires from around a bale of pulp comprising:

moving a bale to a single wire removal location;

rotating the bale about a vertical axis through its center at said wire removal location;

tracking a wire severing tool along the surface of the bale in a generally horizontal plane;

severing the generally vertical wires around the bale by engaging the generally vertical wires across the wire with said severing tool while tracking the wire severing tool in said generally horizontal plane; and removing the severed wires from the bale.

15. An apparatus suitable for removing wire wrapped around a bale comprising:

support means for supporting and rotating the bale about an axis through its center;

means for contacting the wire on the bale at one rotational location of the bale as the bale is rotated and severing the wire;

means for pulling the severed wire off the bale at a second rotational location of the bale as the bale is rotated; and further comprising means for releasably holding severed wires against the bale, wherein the support means rotates about a vertical axis and the means for contacting the wire and the means for pulling the severed wire are integral.

16. A method of removing wires wrapped around a bale of market pulp comprising the steps of:

rotating the bale about a single vertical axis at a first severing location along a path through multiple rotational positions to expose the wires at said severing location;

severing at said severing location at one side of said vertical axis wire on one side of the bale at a first 90 degrees of rotation of the bale;

severing at said same first severing location at said same one side of said vertical axis the wire on a second side of the bale at a second 90 degrees of rotation of the bale; and removing off the bale at said same first severing location at said same one side of said vertical axis the severed wires on the bale.

17. The method of claim 14, further comprising the step of holding the wires against the top surface of the bale during their severing.

18. A method of removing wires wrapped around a bale of market pulp comprising the steps of:

rotating the bale 360 degrees through several rotational positions to expose the wires to a severing location;

severing the wires around two opposite sides of the bale at the first 90 degrees of rotation;

severing the wires around the other two opposite sides of the bale at the second 90 degrees of rotation;

removing the severed wires from the bale; and wherein the step of removing the severed wires includes rotating the bale through a third 90 degree increment to position the severed wires from the first opposite sides for removal, and then rotating the bale through a fourth 90 degree increment to position the severed wires from the remaining opposite sides for removal.

19. The method of claim 18 wherein the step of severing the wires includes engaging the wires with a rotating blade and wherein the step of removing the wire comprises engaging previously severed wires in the same rotating blade and pulling them off the bale.

20. The method of claim 19, further comprising the step of coiling the wires as they are removed from the bale.

21. A method for removing wires strapped around a bale of pulp comprising:

moving a bale to a wire removal location;

rotating the bale about an axis through its center;

tracking a wire severing tool along the surface of the bale;

severing the wires wrapped around the bale;

removing the severed wires from the bale; and wherein the step of severing and removing the wires comprises engaging the wires in the teeth of a rotating blade for breaking the wires and then later pulling the severed wires from the bale using the same rotating blade.

* * * * *